US008740402B2

(12) United States Patent
Chow

(10) Patent No.: US 8,740,402 B2
(45) Date of Patent: Jun. 3, 2014

(54) LED DOWNLIGHT

(76) Inventor: Albert Chow, New Taipei (TW)

( * ) Notice: Subject to any disclaimer, the term of this patent is extended or adjusted under 35 U.S.C. 154(b) by 179 days.

(21) Appl. No.: 13/494,733

(22) Filed: Jun. 12, 2012

(65) Prior Publication Data

US 2013/0329405 A1 Dec. 12, 2013

(51) Int. Cl.
*F21S 8/02* (2006.01)

(52) U.S. Cl.
USPC ..... 362/147; 362/249.02; 362/364; 362/368; 362/373

(58) Field of Classification Search
USPC ..... 362/147, 249.02, 364, 368, 373
See application file for complete search history.

(56) References Cited

U.S. PATENT DOCUMENTS 7,959,332 B2 * 6/2011 Tickner et al. ..... 362/373
8,070,328 B1 * 12/2011 Knoble et al. ..... 362/311.02
8,348,479 B2 * 1/2013 Tickner et al. ..... 362/373
8,591,058 B2 * 11/2013 Concepcion ..... 362/231
2008/0285271 A1 * 11/2008 Roberge et al. ..... 362/235

FOREIGN PATENT DOCUMENTS

TW I360621 3/2012

* cited by examiner

*Primary Examiner* — Stephen F Husar
*Assistant Examiner* — James Cranson, Jr.
(74) *Attorney, Agent, or Firm* — Muncy, Geissler, Olds & Lowe, P.C.

(57) ABSTRACT

An LED downlight mounted onto a construction wall panel comprises a light source module and a heat sink holder. The light source module includes a light projection portion, a base to hold the light projection portion and a first coupling portion connected to the base. The heat sink holder includes a second coupling portion fastened to the first coupling portion and a first cooling portion formed on the outer surface of the heat sink holder and extended along the extension direction of the construction wall panel. The base and first cooling portion have respectively a first clamp surface corresponding to a decorative surface of the construction wall panel and a second clamp surface corresponding to a mask surface of the construction wall panel. The first and second clamp surfaces are respectively in contact with the decorative surface and mask surface to clamp the construction wall panel.

8 Claims, 5 Drawing Sheets

LED DOWNLIGHT

FIELD OF THE INVENTION

The present invention relates to an LED (light emitting diode) downlight and particularly to an LED downlight mounted onto a construction wall panel and cooled via the contact surfaces of the LED downlight and the construction wall panel.

BACKGROUND OF THE INVENTION

Advance of life quality has made people more demanding on lighting and ambient aesthetics. In the past lighting fixtures mostly are exposed outside the construction wall panels that spoiled overall aesthetic design. In recent years downlights wedged in the construction wall panels with only light projection elements exposed outside the decorative surfaces of the construction wall panels have been developed and marketed to provide some improvement. For instance, R.O.C. patent No. 1360621 discloses a downlight which includes a latch member or an elastic element to provide a retaining force to wedge the downlight in a construction wall panel. The elastic element is an elastic arm. Nowadays lighting fixtures using LED as the main light source generally have a heat dissipation element to disperse waste heat generated by the LED, such as a heat sink in the aforesaid patent. To enable the heat dissipation element to achieve desired cooling effect, it is commonly made of high heat conductive material, such as iron, aluminum, copper or alloys thereof. The heat dissipation element thus made is quite heavy and its latch structure cannot provide sufficient retaining force after a long-term period of time to bear such heavy heat dissipation element. As a result, the downlight is prone to wobble and cannot be firmly mounted onto the construction wall panel, or even the downlight could easily loosen away from the installed location. Moreover, the weight of the heat dissipation element also limits the amount of the retaining force generated by the latch structure.

These days the heat dissipation element and light emission element generally are coupled together via a set of fastening elements, such as rivets or screws, and a flat cooling contact surface is formed between them to transmit the waste heat generated by the light emission element to the heat dissipation element. Such a structure tends to generate deformation on the fastening elements because of the heat and results in alteration of the cooling contact surface to decrease cooling efficiency. If this problem is not properly fixed, the waste heat accumulates in the light emission element and could cause heat exhaustion or other problems to the light emission element. How to overcome the aforesaid problems and improve the existing downlights are still issues needed to be resolved.

SUMMARY OF THE INVENTION

The primary object of the present invention is to provide an LED downlight with improved cooling effect.

Another object of the invention is to provide more secure fastening of the downlight to solve the problem of infirm fastening through a latch structure that occurs to the conventional downlight.

To achieve the foregoing objects, the present invention provides an LED downlight mounted onto a construction wall panel. It comprises a light source module and a heat sink holder. The light source module includes a light projection portion, a base to hold the light projection portion and a first coupling portion connected to the base. The heat sink holder includes a second coupling portion fastened to the first coupling portion and a first cooling portion formed on the outer surface of the heat sink holder and extended along the surface of the construction wall panel. The base and first cooling portion have respectively a first clamp surface and a second clamp surface corresponding to a decorative surface and a mask surface of the construction wall panel. The first and second clamp surfaces are respectively in contact with the decorative surface and mask surface to clamp the construction wall panel.

In one embodiment the base has an ancillary operation portion to allow a mechanical tool to clamp and drive the light source module to move.

In another embodiment the first and second coupling portions have respectively a screw structure mating and fastening to each other.

In yet another embodiment the heat sink holder includes a second cooling portion formed on the outer surface thereof and perpendicular to the extension direction of the mask surface.

In yet another embodiment the second coupling portion of the heat sink holder includes a wedge portion butting the inner wall of an installation port of the construction wall panel.

In yet another embodiment the light source module includes a drive module located on the base to drive the light projection portion to generate illumination light.

In yet another embodiment the base includes power cord electrically connected to the drive module.

In yet another embodiment the heat sink holder includes a threading hole threaded through by the power cord.

By means of the structure set forth above, the base and first cooling portion clamp the construction wall panel to allow the LED downlight to be mounted thereon. Compared with the latch structure of the conventional techniques the base and first cooling portion have two clamp surfaces to provide more secure installation. Moreover, waste heat generated by the light source module, aside from dispersing to the atmosphere, also can be transmitted via the first clamp surface and dispersed via the construction wall panel.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
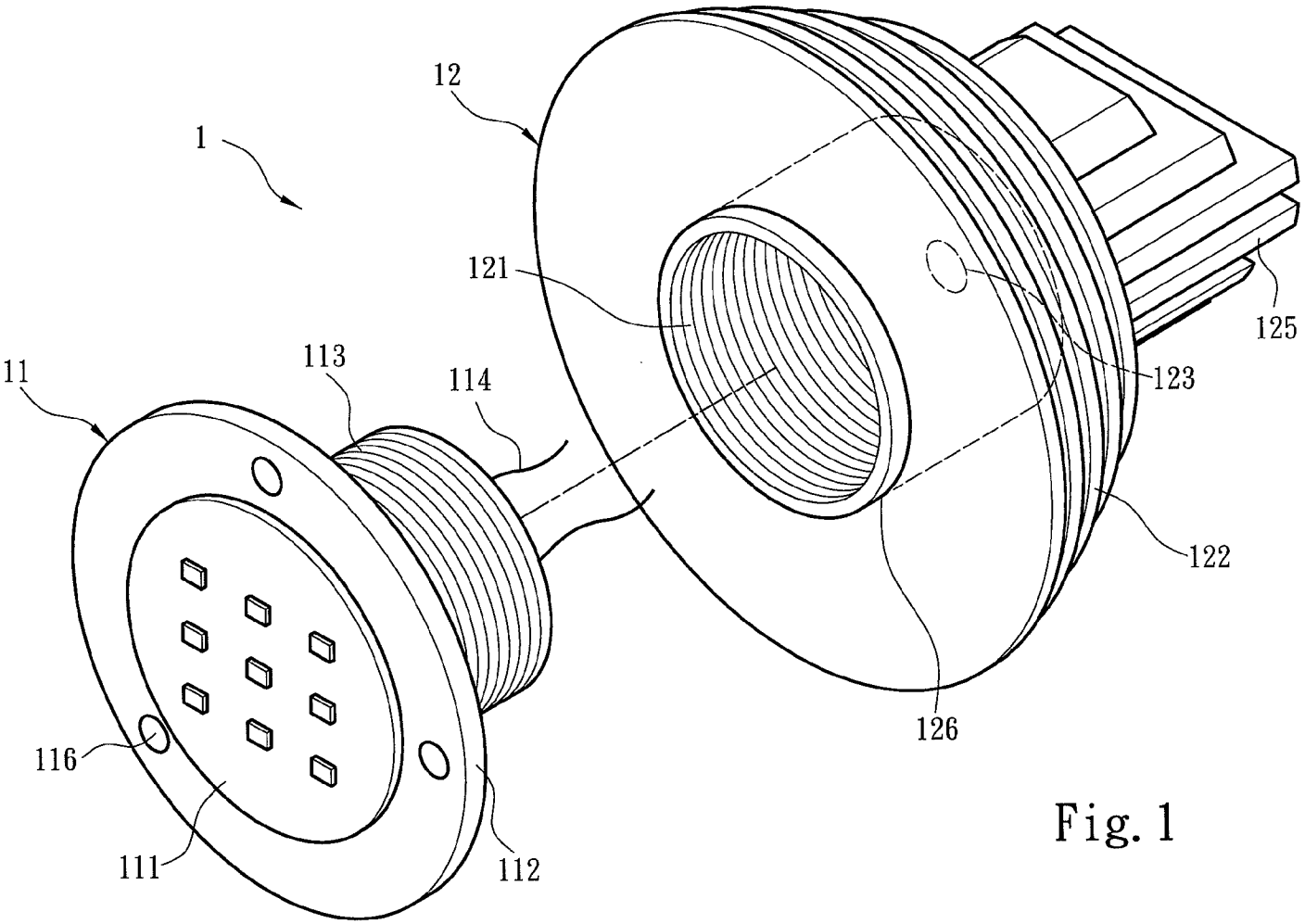
FIG. 1 is an exploded perspective view of the invention.
Figure 2:
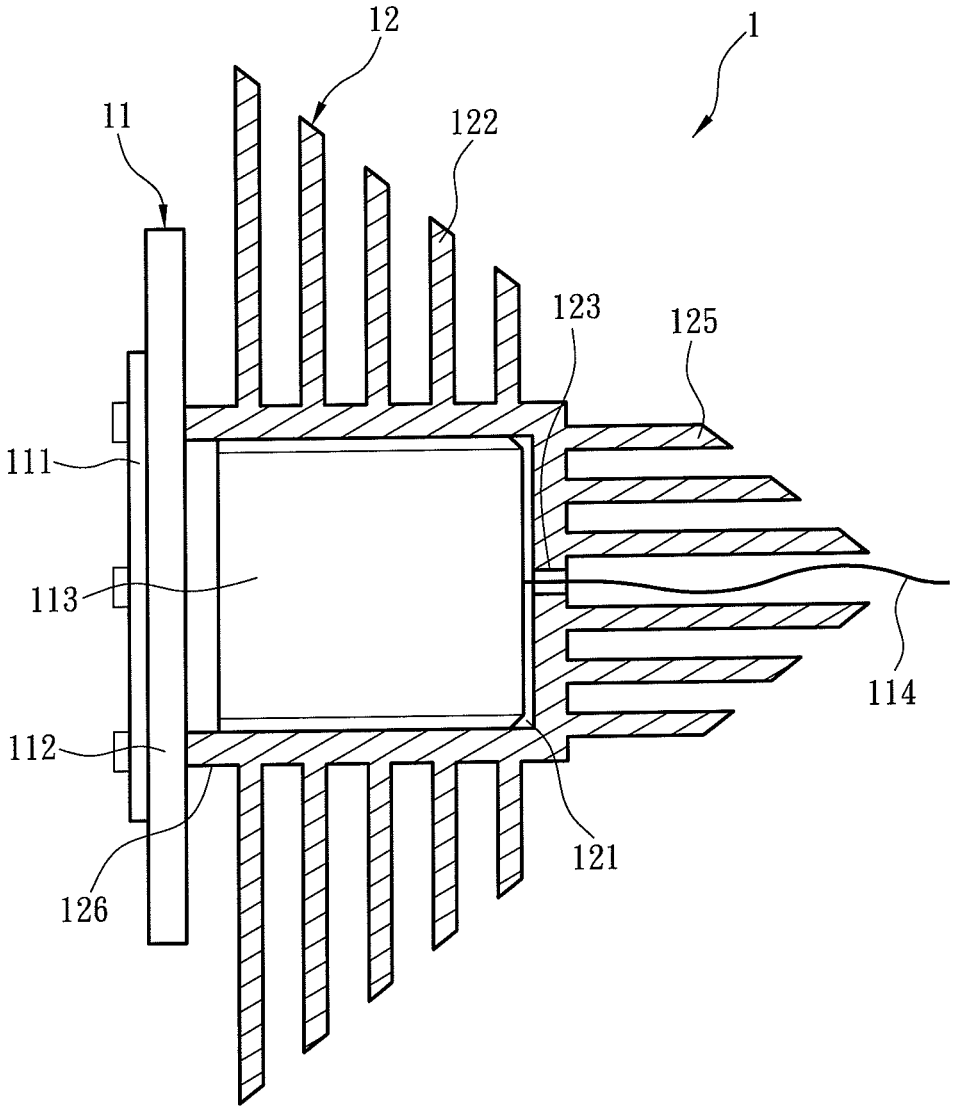
FIG. 2 is an exploded sectional view of the invention.

Please refer to FIGS. 1 and 2, the present invention aims to provide an LED downlight 1 which comprises a light source module 11 and a heat sink holder 12. The light source module 11 includes a light projection portion 111, a base 112 to hold the light projection portion 111 and a first coupling portion 113 connected to the base 112. The heat sink holder 12 includes a second coupling portion 121 fastened to the first coupling portion 113 and a first cooling portion 122 extended from the surface of the heat sink holder 12. The base 112 has a drive module (not shown in the drawings) which can be a start circuit or a conversion circuit to drive the light projection portion 111 to generate illumination light. The base 112 has a power cord 114 with one end electrically connected to the drive module and another end electrically connected to an external power source (not shown in the drawings) to get electric power required in operation. The heat sink holder 12 also has a threading hole 123 threaded through by the power cord 114. The threading hole 123 can run through the heat sink holder 12 to communicate with the second coupling portion 121. The first and second coupling portions 113 and 121 have respectively a screw structure mating each other for screwing together, but this is not the limitation of the invention.

Figure 3:
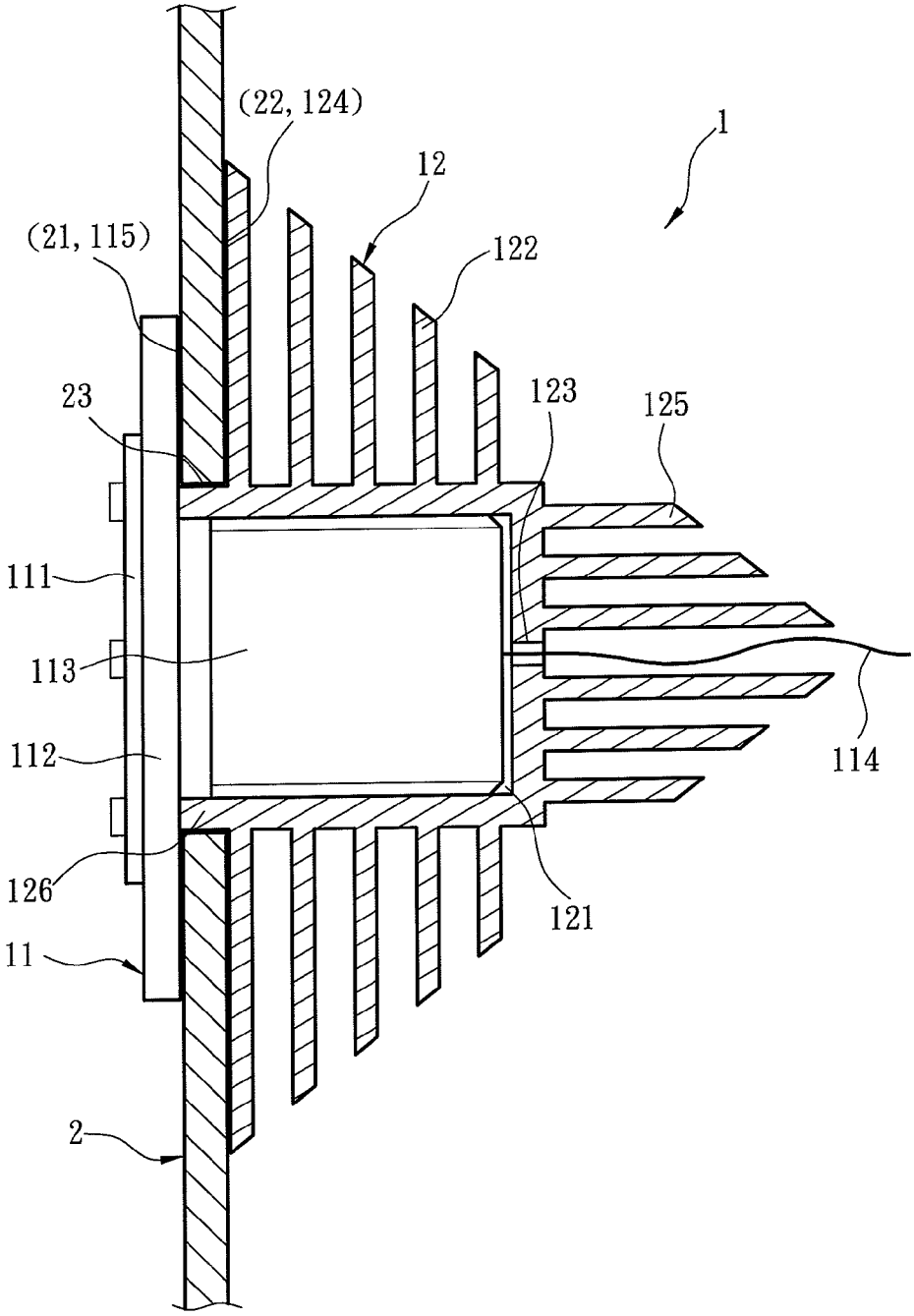
FIG. 3 is a sectional view of the invention in installation.
Figure 4:
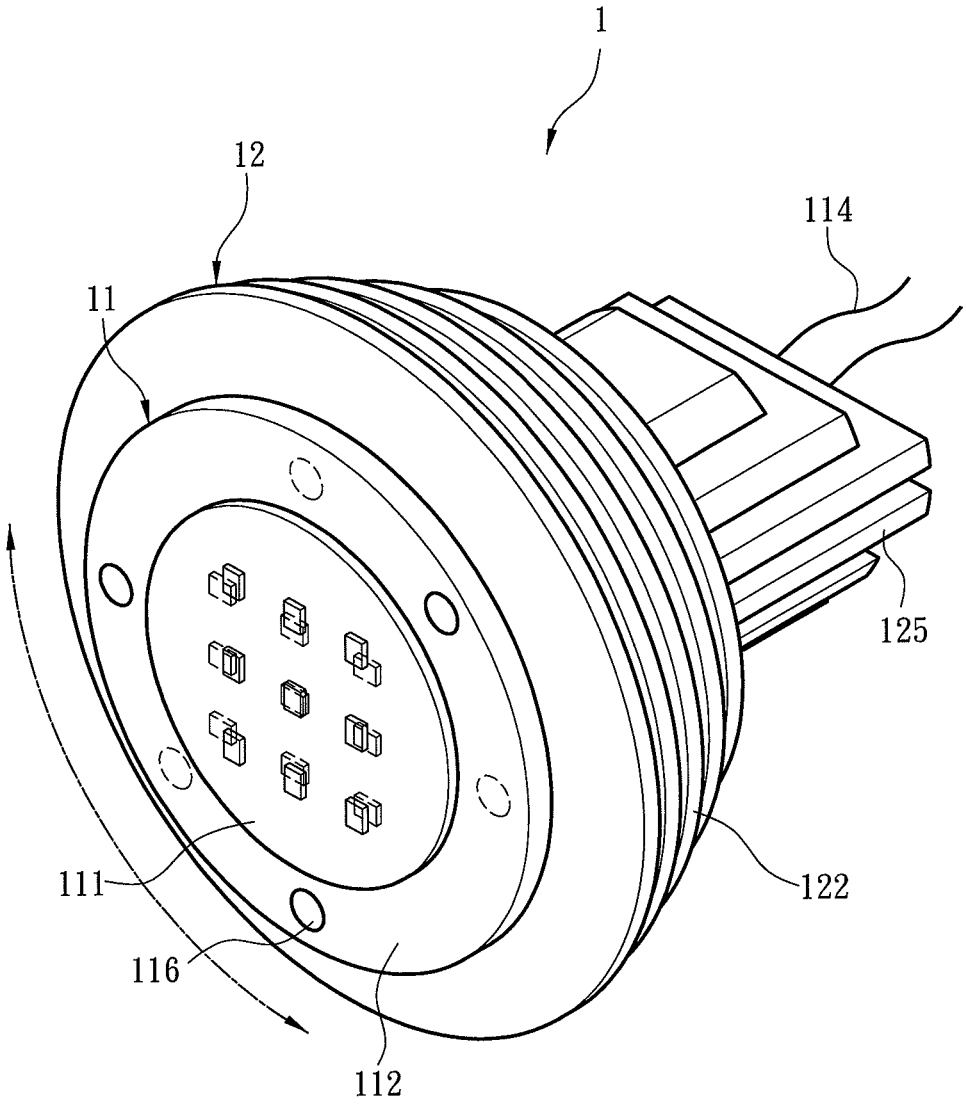
FIG. 4 is a perspective view of the invention in an assembly condition.
Figure 5:
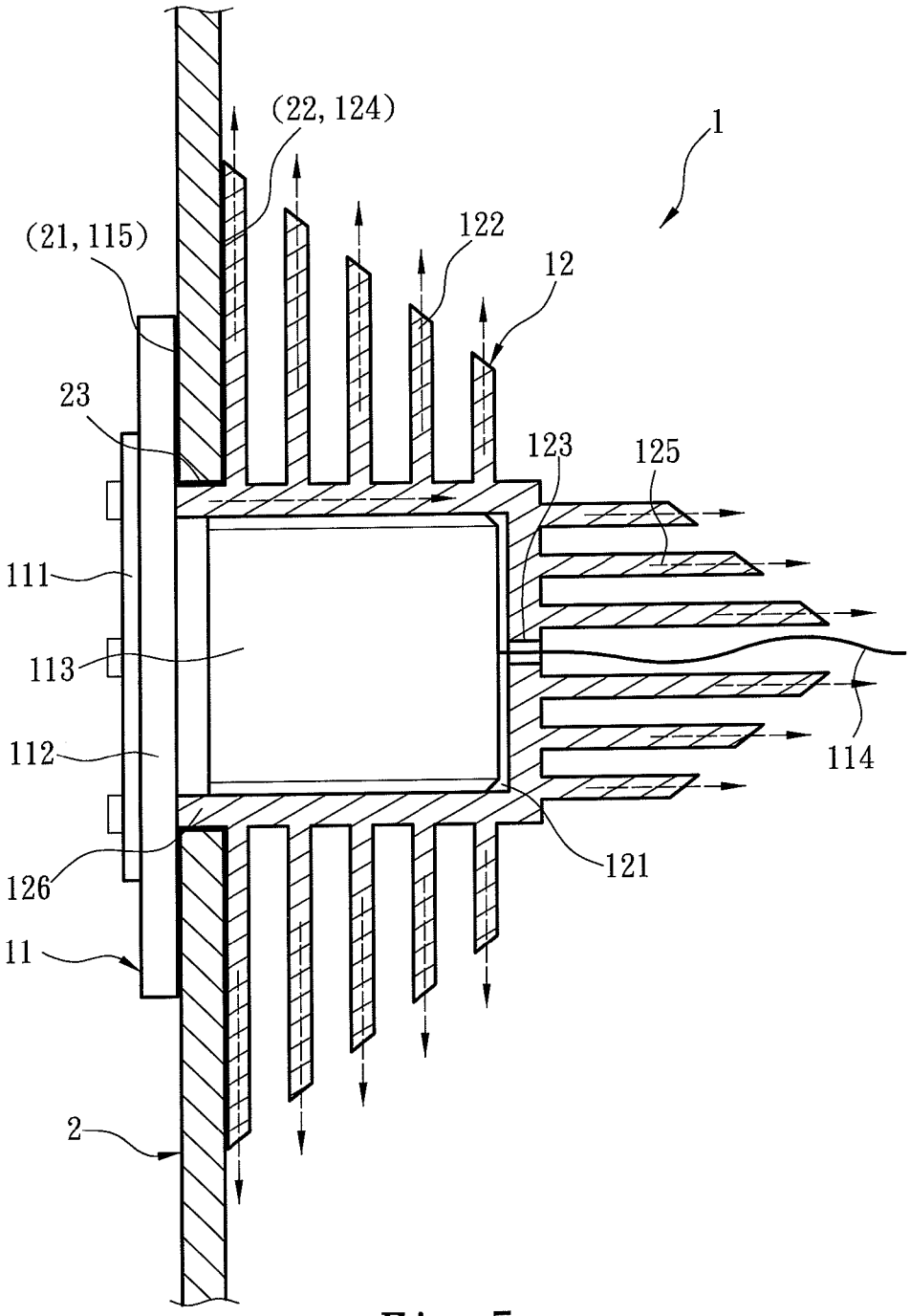
FIG. 5 is a sectional view of the invention in an assembled and installed condition.

Please refer to FIGS. 3, 4 and 5 for the LED downlight 1 of the invention installed on a construction wall panel 2. The construction wall panel 2 has a decorative surface 21, a mask surface 22 and an installation port 23 running through the decorative surface 21 and mask surface 22. The construction wall panel 2 can also be a wall or ceiling. At the beginning, the installation port 23 is perforated on the construction wall panel 2 in advance; next, the heat sink holder 12 is mounted onto one side of the construction wall panel 2 where the mask surface 22 is formed to allow the second coupling portion 121 to correspond to the installation port 23; then the first cooling portion 122 butts the mask surface 22 to form a second clamp surface 124, and the light source module 11 is mounted onto another side of the construction wall panel 2 where the decorative surface 21 is formed with the first coupling portion 113 running through the installation port 23 and coupling with the second coupling portion 121; then the base 112 presses the decorative surface 21 to form a first clamp surface 115, thereby the construction wall panel 2 is clamped by the first and second clamp surfaces 115 and 124 to hold the LED downlight 1 securely onto the construction wall panel 2 as shown in FIG. 4, but this is not the limitation of the invention. After installation of the LED downlight 1 is finished, users can see only the light source module 11 mounted onto the decorative surface 21 without seeing the heat sink holder 12 mounted onto the mask surface 22. Such a design does not spoil the aesthetic appeal of the lighting fixture in the ambience. Compared with the conventional downlight installed merely through a latch structure to form the point contact, the invention provides a clamp structure with a larger contact area, thus can generate firmer fastening. After the LED downlight 1 has been installed, waste heat generated by the light source module 11 during operation can be transmitted via the first coupling portion 113 to the second coupling portion 121 and dispersed through the first cooling portion 122. Moreover, the second clamp surface 124 formed by clamping of the first cooling portion 122 and mask surface 22 also can disperse heat.

In the aforesaid embodiment, the first cooling portion 122 is formed by extending along the horizontal direction of the surface of the construction wall panel 2 as shown in FIG. 3, i.e. the first cooling portion 122 is formed on the outer surface of the heat sink holder 12 and extended along the extension direction of the mask surface 22. In addition, a second cooling portion 125 can be added and formed on the surface of the heat sink holder 12 perpendicular to mask surface 22.

In another embodiment of the invention, the first cooling portion 122 can be formed in fins spaced from each other at a desired distance. The fins have different diameters and can be formed in a trapezoidal shape with a wider lower side and narrower upper side. The profiles of the first and second cooling portions 122 and 125 shown in the aforesaid embodiment are examples and serve for illustrative purpose only, and are not the limitation of the invention. The first and second cooling portions 122 and 125 can be made integrally on the heat sink holder 12 by aluminum extrusion or stamping. The heat sink holder 12 can be made of high heat conductive material, such as iron, aluminum, copper and alloys thereof.

In another embodiment, the second coupling portion 121 can have a wedge portion 126 to align quickly with the installation port 23 and press the inner rim thereof to facilitate faster installation of the heat sink holder 12 on the construction wall panel 2.

In yet another embodiment, the base 112 of the light source module 11 further has an ancillary operation portion 116 to allow a mechanical tool to clamp so that the light source module 11 can be driven by the mechanical tool to facilitate coupling with the heat sink holder 12. The mechanical tool (not shown in the drawings) can be a hand tool or pneumatic tool.

As a conclusion, the invention provides the base and first cooling portion respectively corresponding to the decorative surface and mask surface of the construction wall panel to form the first and second clamp surfaces so that the LED downlight can be securely clamped and mounted onto the construction wall panel. Compared with the latch structure of the conventional techniques the invention provides much firmer installation. Moreover, waste heat generated by the light source module can be dispersed into the atmosphere via the heat sink holder, and also can be transmitted and dispersed via the first clamp surface and construction wall panel.

While the preferred embodiments of the invention have been set forth for the purpose of disclosure, they are not the limitations of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An LED downlight mounted onto a construction wall panel which includes a decorative surface, a mask surface and an installation port communicating with the decorative surface and the mask surface, the LED downlight comprising:

a light source module which is located on one side of the construction wall panel where the decorative surface is formed and includes a light projection portion to generate illumination light, a base to hold the light projection portion and a first coupling portion connecting to the base and running through the installation port; and a heat sink holder which is located on another side of the construction wall panel where the mask surface is formed and includes a second coupling portion corresponding to the first coupling portion for fastening together and a first cooling portion formed on an outer surface of the heat sink holder and extended along an extension direction of the mask surface;

wherein the base and the first cooling portion include respectively a first clamp surface corresponding to the decorative surface and a second clamp surface corresponding to the mask surface, the first clamp surface and the second clamp surface being respectively in contact with the decorative surface and the mask surface to clamp the construction wall panel.

2. The LED downlight of claim 1, wherein the base includes an ancillary operation portion to allow a mechanical tool to clamp and drive the light source module to move.

3. The LED downlight of claim 1, wherein the first coupling portion and the second coupling portion are respectively a screw structure mating and fastenable with each other.

4. The LED downlight of claim 1, wherein the heat sink holder includes a second cooling portion formed on the outer surface thereof and perpendicular to the extension direction of the mask surface.

5. The LED downlight of claim 1, wherein the second coupling portion includes a wedge portion butting an inner wall of the installation port.

6. The LED downlight of claim 1, wherein the light source module includes a drive module located in the base to drive the light projection portion to generate the illumination light.

7. The LED downlight of claim 6, wherein the base includes a power cord electrically connected to the drive module.

8. The LED downlight of claim 7, wherein the heat sink holder includes a threading hole threaded through by the power cord.

* * * * *